United States Patent [19]

Kawamata

[11] 3,977,342

[45] Aug. 31, 1976

[54] METHOD OF MANUFACTURING A METALLIC CAN

[75] Inventor: Kiyoshi Kawamata, Ohmiya, Japan

[73] Assignee: Nihon Seikan Kabushiki Kaisha, Ohmiya, Japan

[22] Filed: May 28, 1975

[21] Appl. No.: 582,411

Related U.S. Application Data

[63] Continuation of Ser. No. 453,023, March 20, 1974, abandoned.

[30] Foreign Application Priority Data

Sept. 13, 1973 Japan ..... 48-103543

[52] U.S. Cl. ..... 113/120 K; 113/120 Y; 113/19

[51] Int. Cl.[2] ..... B21D 51/32

[58] Field of Search ..... 113/1 E, 30, 120 K, 113/120 Y, 19, 16, 18 A, 23 A, 23 B, 23 E, 23 F, 24 R, 24 D, 24 E, 24 F, 24 G, 24 H; 220/67, 77, 78, 79

[56] References Cited

UNITED STATES PATENTS

| | | | |
|---|---|---|---|
| 1,351,831 | 9/1920 | Brenzinger | 113/23 A |
| 1,703,431 | 2/1929 | Schroeder | 113/19 |
| 1,744,661 | 1/1930 | Nelson | 113/24 H |
| 2,171,714 | 9/1939 | Schrader | 220/67 |
| 2,460,296 | 2/1949 | Kinney | 113/19 |
| 2,814,416 | 11/1957 | Campbell et al. | 113/120 K |

FOREIGN PATENTS OR APPLICATIONS

| | | | |
|---|---|---|---|
| 724,340 | 7/1943 | Germany | 113/120 K |

*Primary Examiner*—Lowell A. Larson
*Attorney, Agent, or Firm*—Wenderoth, Lind & Ponack

[57] ABSTRACT

A method of manufacturing a metallic can formed like a case container, comprising forming a four-fold seamed edge portion by folding and seaming by adhesive means edges of a sheet for building a can body. The four-fold seamed edge portion is included in a curled and seamed portion which is formed by curling and pressing the flanged edge portion of an end plate together with the marginal portion of the can body. All layers of the seamed sheet are tightly joined opposite each other in the curled and seamed portion, thus hermetically sealing a finished can.

3 Claims, 11 Drawing Figures

METHOD OF MANUFACTURING A METALLIC CAN

This is a continuation of application Ser. No. 453,023 filed Mar. 20, 1974, now abandoned.

BACKGROUND OF THE INVENTION

In a conventional metallic can, such as an eighteen liter can, soldering means is employed for hermetically sealing the curled and seamed portion of a finished can. This presents disadvantages, however, since it involves an additional soldering process for a finished can, and a process for cleaning the finished can which results in extra equipment and labor for disposal of water used therefor. This problem has long been studied to develop an improved process, but it remains yet to be solved.

A method of using adhesive material instead of soldering means for manufacturing a cylindrical can or a small-size can in particular has been developed, and particularly used for seaming the edges of sheets for building a can body as well as sealing the curled and seamed portion of the can. However, this method does not apply to a large size metallic can such as a case container, as the seamed edge portion of the can body is not sufficient for sealing the curled and seamed portion. Therefore, it has long been desired to improve that portion for the large-size can.

The cause for the above problem is considered to be that, as the seamed edge portion of the can body is not included in the curled and seamed portion for hermetically supporting it, gaps or less coherence may be produced along the seamed edge portion of a finished can.

SUMMARY OF THE INVENTION

According to the invention, however, a sheet for building a can body is provided at all four corners thereof with a substantially smaller cut than that of the prior art. The opposite sides of the blank are seamed together to include a four-layer seam and a two-layer part. The peripheral marginal portion of the can body is curled with the flange of an end plate to form an overlapped portion such that the two-layer part is curled during the curling process while the four-layer seam is not curled but has a part which rests inside the overlapped portion. A finished can thus obtained has the overlapped portion seen from outside to have the same form as usual. The adhesive material applied expands over all areas of the curled and seamed portion, when heated, for hermetically sealing the can.

The sealing effect thus achieved by the present invention is substantially equal to or greater than that by soldering means according to prior art processes.

A metallic can manufactured according to the invention has improvements over all prior art systems using soldering means, since the opposite sides of the sheet blank for building a can body are seamed together by using adhesive material to provide a four-layer seam and a two-layer part, and an overlapped portion provided by the curling process includes a part of the four-layer seam portion of the can body which is not curled but which supports the overlapped portion.

In a conventional metallic can, a sheet for building a can body is provided with cut portions at four corners, such cut portions being provided such that the seamed edge portion of the can body is not included in the curled and seamed portion of a finished can, as indicated in FIGS. 10 and 11. This may produce gaps O and P shown in FIG. 10, as the curled and seamed portion does not include the seamed edge portion of the can body. Even if no such gaps arise there is less coherence at the portions O and P than the other portions, resulting in possible leakage of contents from the finished can. In order to prevent leakage, soldering means is employed at all seamed and curled portions for hermetically sealing the finished can.

It is therefore one object of the present invention to provide a method of manufacturing a metallic can in which a sheet blank has all four corners thereof cut to equally smaller dimensions than usual, and has the opposite sides thereof seamed together by adhesive means to provide a four-layer seam and a two-layer part.

It is another object of the present invention to provide a method of manufacturing a metallic can in which a sheet blank has all four corners thereof cut equally to a height one half as deep as usual, and has the opposite sides thereof seamed together by adhesive means for building a can body such that the thus seamed side portion includes a two-layer part and a four-layer seam. The two-layer part is curled with the flange of an end plate during the curling process, while the four-layer seam is not curled but has a part thereof which rests inside an overlapped portion formed by the curling process.

It is a further object of the present invention to provide a method of manufacturing a metallic can in which the overlapped portion formed by the curling process and which includes all layer parts is pressed toward chuck means provided with a concave portion of a depth equal to four layer thicknesses of the sheet and of a height which covers the height of the overlapped portion.

It is a further object of the present invention to provide a metallic can manufactured according to the method, which has the overlapped portion tightly secured for hermetically sealing the can and in the same form as usual.

BRIEF DESCRIPTION OF THE DRAWINGS

FIGS. 3 thru 8 show a sequence of curling and pressing according to the invention, in which FIG. 3 is a plan view before curling FIG. 4 is a sectional view taken along the line A — A in FIG. 3;

FIG. 5 is a plan view in an intermediate step of curling;

FIG. 6 is a sectional view taken along the line B — B in FIG. 5;

FIG. 7 is a plan view in a final stage; and

FIG. 8 is a sectional view taken along the line C — C in FIG. 7.

DETAILED DESCRIPTION OF THE INVENTION

Figure 1:
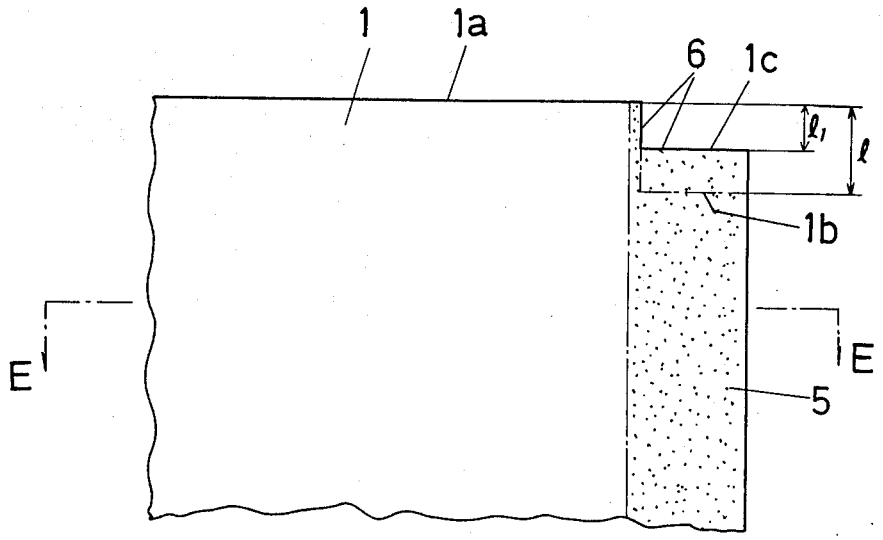
FIG. 1 is a plan view of part of a sheet for building a can body according to the present invention.
Figure 2:
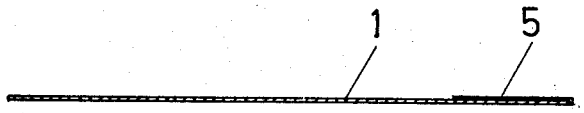
FIG. 2 is a partly enlarged sectional view taken along the line E — E in FIG. 1.

This invention relates to a method of manufacturing a metallic can wherein the edges of a sheet blank are folded and joined and seamed together by application of adhesive material for forming a can body, and a curled and seamed portion is provided by curling and pressing the flanged edge of an end plate and the marginal portion of the can body. The curled and seamed portion is partly pressed toward the concave portion of a chuck, thereby tightly hermetically joining all parts therein.

The invention will further be described by way of the following examples with reference to the accompanying drawings.

A sheet blank 1 for building a can body has all four corners thereof equally cut at a depth $l_1$ equal to one half that conventionally employed (or $l_1 = l/2$). The side portions of the sheet blank 1 to be seamed are coated with adhesive material 5 in a suitable layer and width. Adhesive material 5 is also applied along the edges of all of the cut portions. The seaming operation is performed in the usual manner for forming a can body with a generally square cross-section. The flanged edge portion 2*a* of an end plate 2 is curled and pressed together with the peripheral marginal portion 1*a* of the can body. This is also done in the usual manner.

A chuck 3 is provided and has a concave portion 4 having a depth substantially equal to four times the thickness of the sheet blank and a height which covers the height of an overlapped portion provided at the seamed side portion by the curling process. The chuck 3 is located opposite the overlapped portion so that the latter is pressed toward the concave portion 4 till it exactly fits the portion 4.

The curling and pressing operation may be performed in the usual manner, but care should be taken so that the overlapped portion may be curled and pressed to a desired form, since it includes a part of a four-layer seam which is not curled during the curling and pressing operation with the flanged portion 2*a*.

Figure 10:
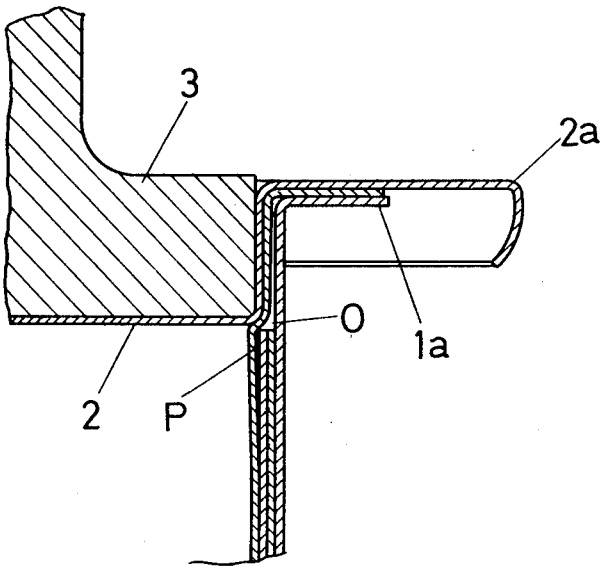
FIG. 10 is a sectional view taken along the line D — D in FIG. 9.
Figure 11:
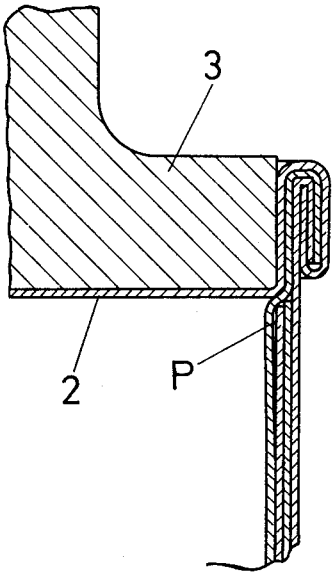
FIG. 11 is a sectional view in a final stage of a conventional process.

A sheet for building a can body according to the prior art is cut at four corners to provide a height l as indicated by the dot-dash lines 1*b* in FIG. 1. The four-layer seamed side portion of the can body is not extended to or included in the curled and seamed portion. This portion is cut short as shown at 0 in FIG. 10, or located on a level with a recessed bottom of the end plate. This may produce a gap P as shown in FIG. 10 when the flanged portion of the end plate is curled and pressed with the peripheral marginal portion of the can body, or the portion P may become less tight or coherent than other parts. Accordingly, this may badly affect the sealing condition of a finished can.

Figure 4:
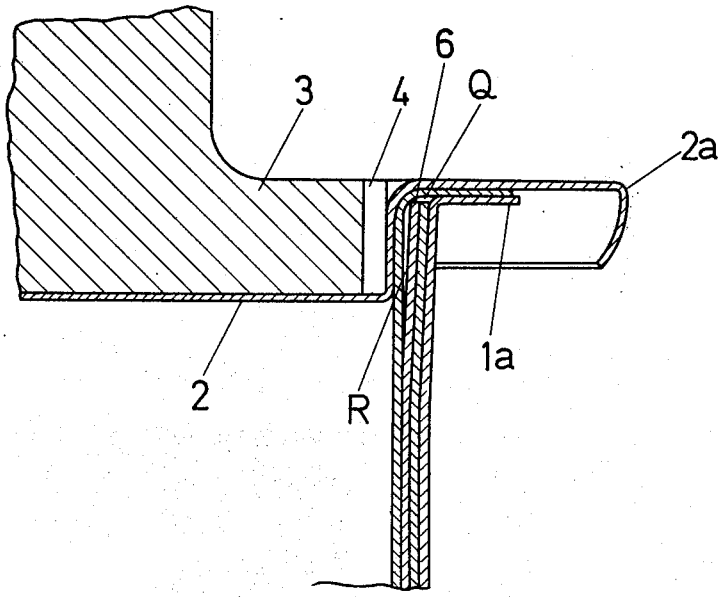

According to the invention, however a sheet blank 1 is cut at four corners to a smaller depth as indicated by the solid line 1*c* in FIG. 1. The seamed side portion of the can body thus includes a two-layer part and a four-layer seam. The two-layer part is curled with the flanged portion 2*a* during the curling process, whereas the four-layer seam is not curled but has a part thereof included inside an overlapped portion provided at the seamed side portion during the curling process, as shown at Q in FIG. 4. In FIG. 4, a portion R exists before the curling and pressing operation, but it becomes tighter as it is further pressed toward the concave portion 4. Finally, the portion R is closed tightly as indicated at S in FIG. 8. Both the seamed side portion and the curled portion are thus tightened for hermetically sealing the can without application of soldering means.

The sheet blank 1 is coated with adhesive material over the entire area of the sides thereof to be seamed together and along the edges 6 of the four cut portions. This prevents all adhesive coated parts from gathering rust. When a finished can or the adhesive coated portion thereof is heated, the adhesive material is melted to form a bond between all parts inside the overlapped portion.

In all embodiments described heretofore, water soluble synthetic resin containing olefin polymerized resin of carboxyl base, and polyurethane resin may be employed as adhesive material, but this is not limitative. Any type of adhesive material that is satisfactory in sealing, adhesiveness and chemical stability may be used.

Figure 3:
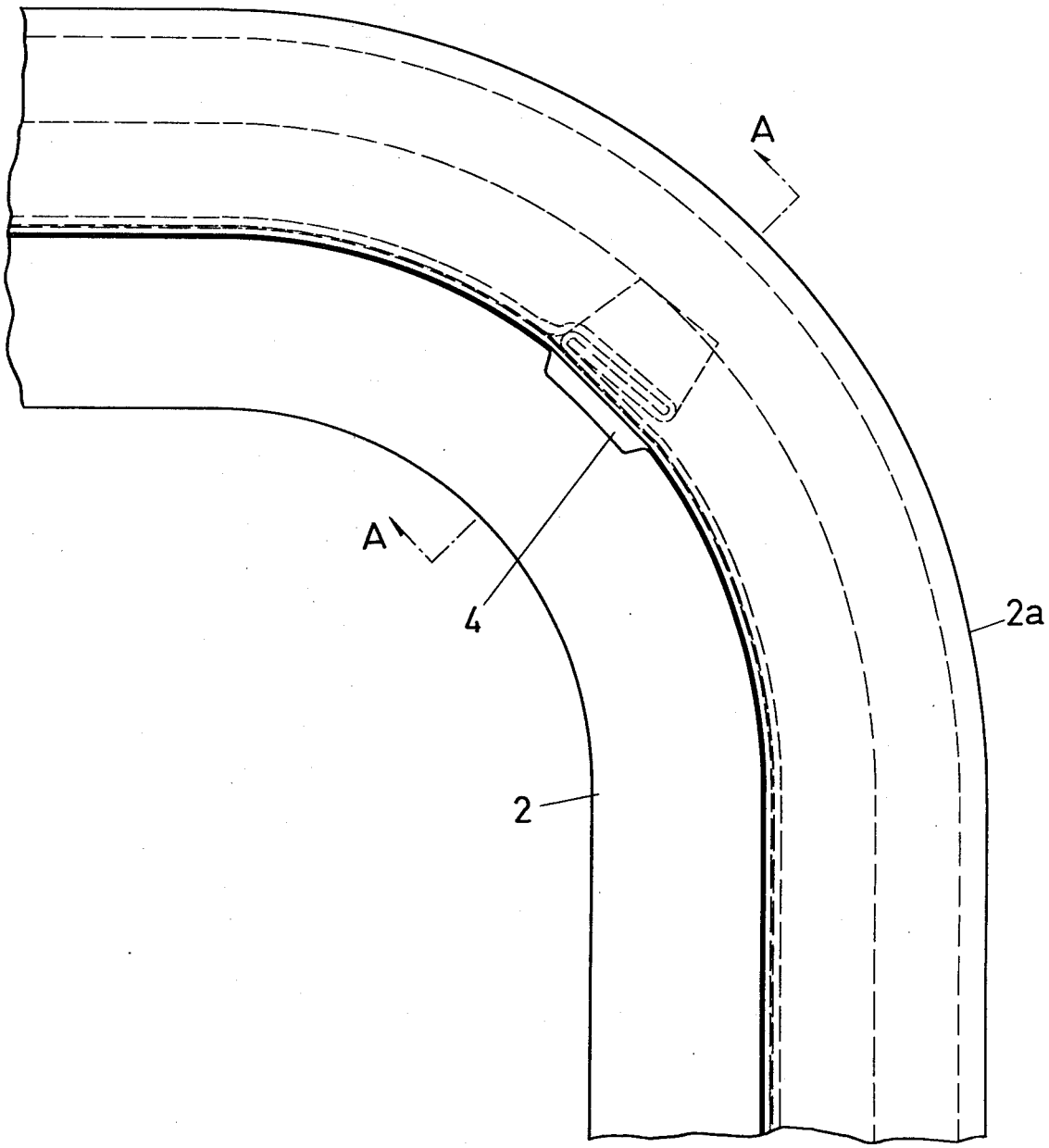
Figure 5:
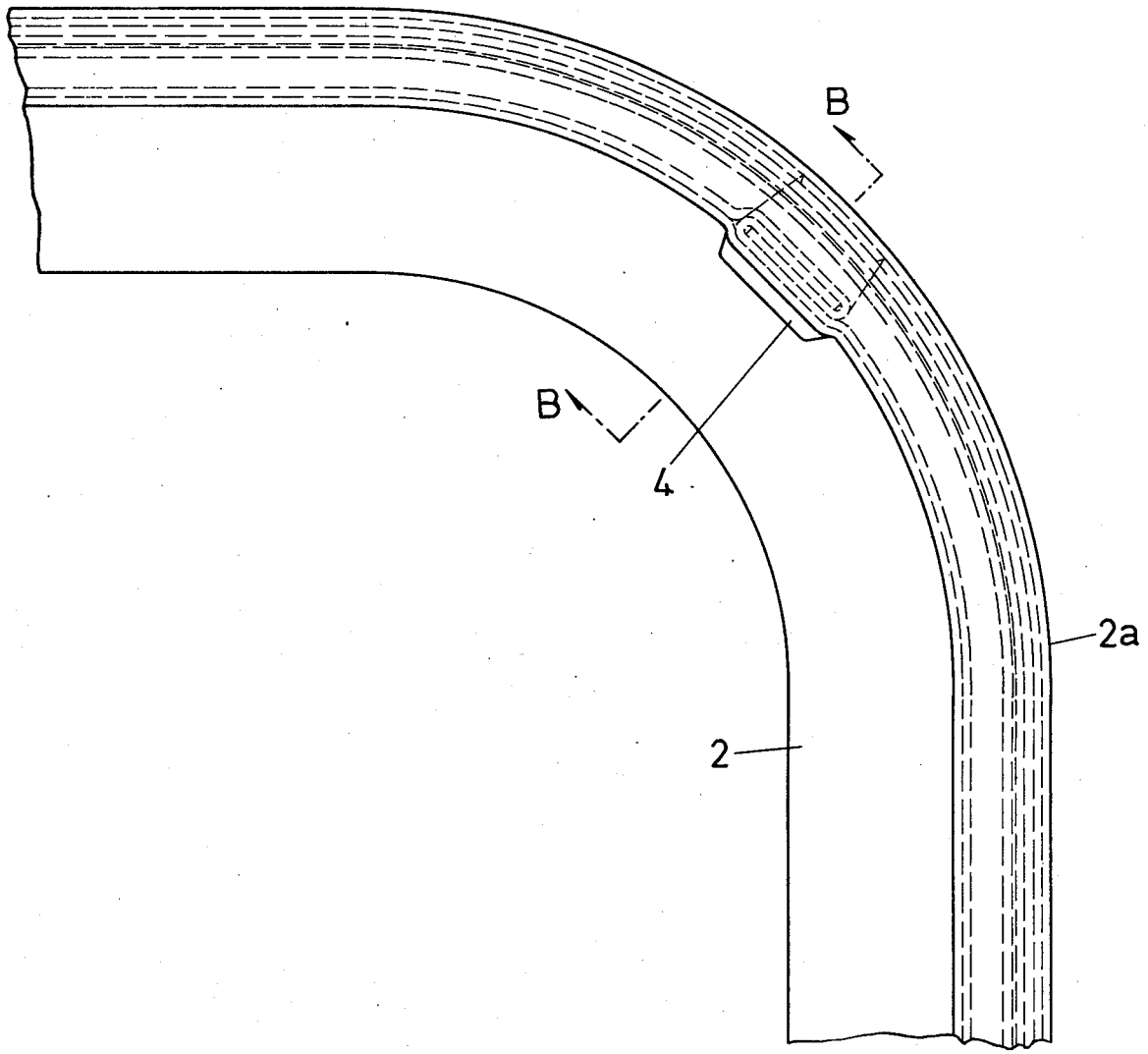
Figure 6:
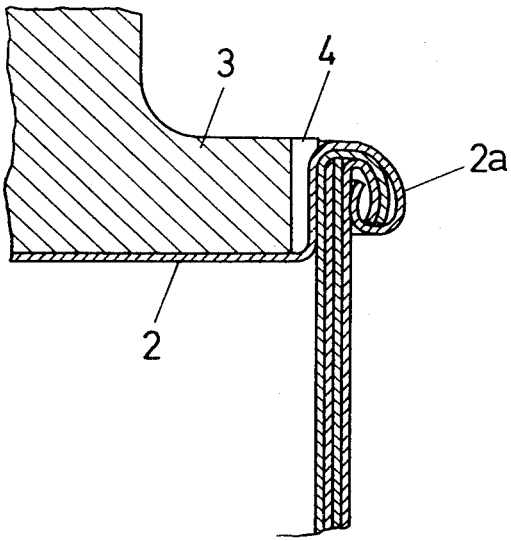
Figure 8:
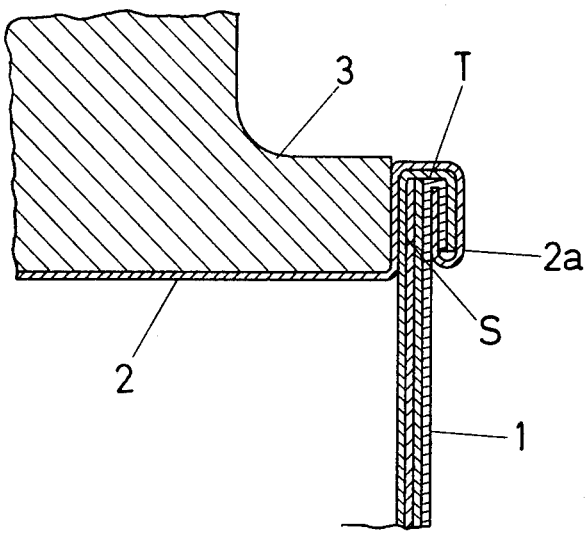
Figure 7:
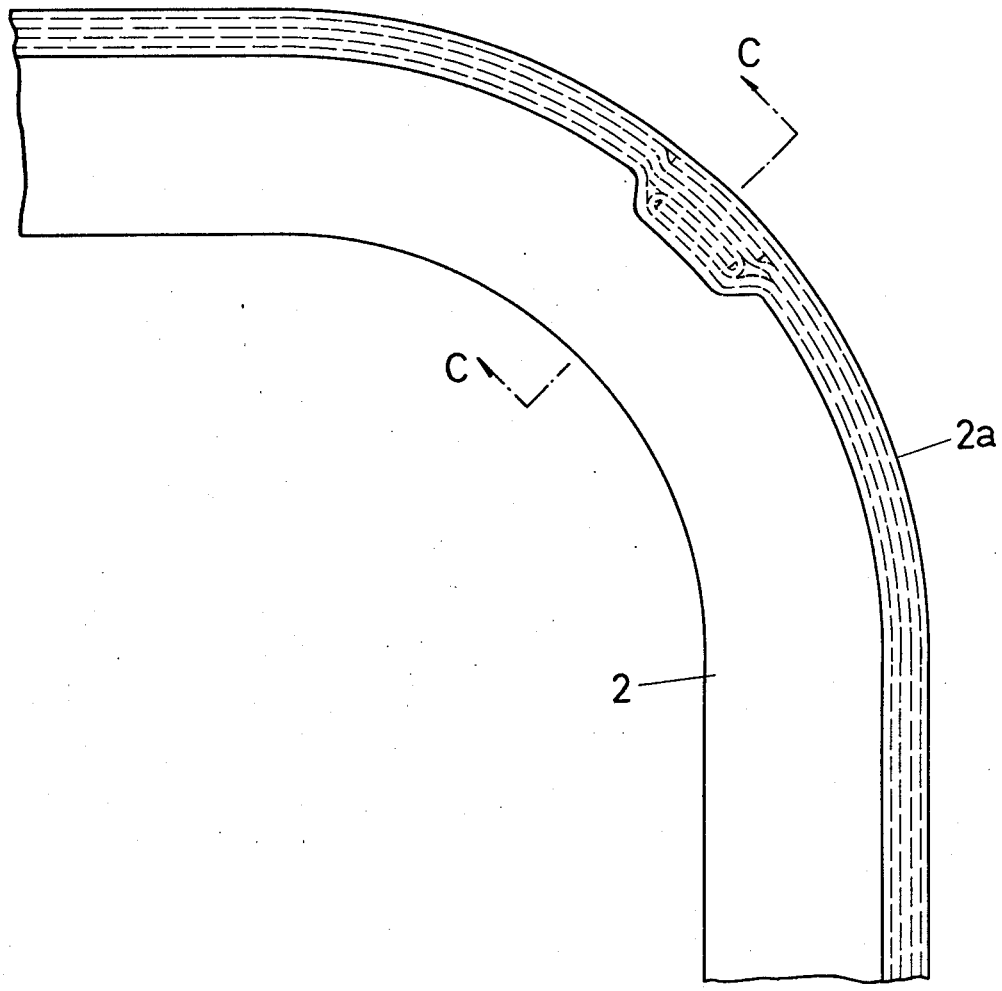
Figure 9:
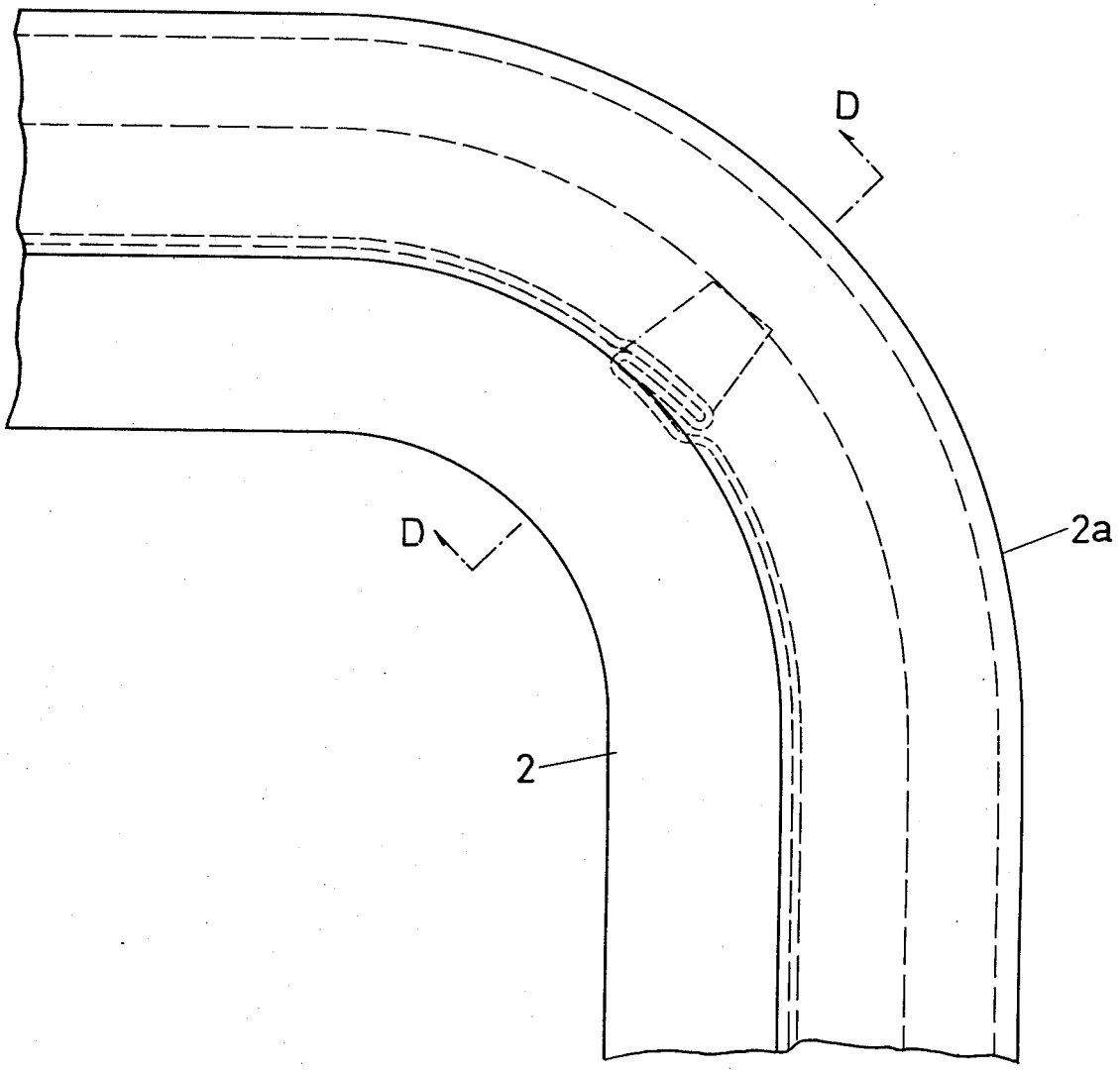
FIG. 9 is a plan view before curling according to a conventional process.

In FIG. 3, the four-layer seam of the can body is shown opposite the concave portion 4 of the chuck before forming a curled and seamed portion by the curling process. In FIG. 4, adhesive material 5 is shown to cover the edges 6 of the cutout portions of sheet blank 1. FIG. 5 shows an intermediate step of the curling and pressing process, in which the four-layer seam is partly located in the concave portion 4. FIG. 7 shows the final step of the curling and pressing operation, in which the four-layer seam is completely pressed to exactly fit the concave portion 4 with all parts in the overlapped portion tightly joined and sealed. When the finished can is heated, the adhesive material layer is melted to develop and spread between all parts in the overlapped portion, as indicated in FIG. 8.

As has been illustrated heretofore, a metallic can obtained according to the invention is hermetically sealed without application of soldering means, since a sheet blank for a can body has all four corners cut by a lesser amount than in prior art processes, and has seamed sides which include a two-layer part and a four-layer seam. The two-layer part is curled with the flange of the end plate, while the four-layer seam is not curled but is located inside the overlapped portion formed during the curling process. This supports and strengthens the overlapped portion, giving a finished can a good appearance and better sealing effect.

The adhesive material applied to the seamed sides and edges of the cut portions prevents these portions from rusting, and keeps the finished can hermetically sealed. The portion thus obtained by curling and pressing is reinforced by the seamed edge portion of the can body therein, and will not deform.

What is claimed:

1. A method of manufacturing a metallic can of generally square cross-section, said method comprising:

providing a rectangular metal sheet blank to form the body of a can;

cutting completely through said blank at all four corners thereof to form equal cutout portions all extending to an equal depth;

applying an adhesive material to opposite sides of said blank to be overlapped and joined to form a can body seam and to edges of said cutout portions;

thereafter folding said opposite sides of said blank to form a can body having a seam including a major intermediate four-layer seam portion and opposite end minor two-layer parts each having a length equal to said depth;

curling at least one end peripheral marginal portion of said can body with a flanged portion of an end plate to form a peripheral curled can portion including an overlapped portion wherein said can body seam overlaps said peripheral curled can portion;

said step of curling including curling said respective two-layer part of said can body seam with said flanged portion of said end plate without curling said four-layer seam portion, and positioning part of said four-layer seam portion within said overlapped portion thereby supporting said overlapped portion;

providing an interior chuck having a concave recess positioned adjacent only said overlapped portion; and said step of curling further including pressing said peripheral curled can portion toward said chuck, and pressing said overlapped portion into said concave recess.

2. A method as claimed in claim 1, wherein said step of cutting comprises cutting away all four said cutout portions to a width equal to substantially the width of said can body seam, and to said equal depth such that an endmost portion of said four-layer seam portion is within said overlapped portion during said step of curling.

3. A method as claimed in claim 1, wherein said step of providing said interior chuck comprises providing said concave recess with a depth equal substantially to four times the thickness of said sheet blank and of a height to receive said overlapped portion during said curling step.

* * * * *